US009902912B2

(12) United States Patent
Banerjee et al.

(10) Patent No.: US 9,902,912 B2
(45) Date of Patent: Feb. 27, 2018

(54) HYDROTREATING COKER KEROSENE WITH A SEPARATE TRIM REACTOR

(71) Applicant: UOP LLC, Des Plaines, IL (US)

(72) Inventors: Soumendra M. Banerjee, New Delhi (IN); Peter Kokayeff, Naperville, IL (US); Vikrant Vilasrao Dalal, Haryana (IN); Priyesh Jayendrakumar Jani, Haryana (IN); David Lindsay, Benicia, IL (US); Yoga Ayar, Buffalo Grove, IL (US)

(73) Assignee: UOP LLC, Des Plaines, IL (US)

( * ) Notice: Subject to any disclaimer, the term of this patent is extended or adjusted under 35 U.S.C. 154(b) by 533 days.

(21) Appl. No.: 14/167,839

(22) Filed: Jan. 29, 2014

(65) Prior Publication Data

US 2015/0210939 A1 Jul. 30, 2015

(51) Int. Cl.

| | |
|---|---|
| ***C10G 65/04*** | (2006.01) |
| ***C10G 65/06*** | (2006.01) |
| ***C10G 67/06*** | (2006.01) |

(52) U.S. Cl.

CPC ..... *C10G 65/04* (2013.01); *C10G 65/06* (2013.01); *C10G 67/06* (2013.01); *C10G 2300/202* (2013.01)

(58) Field of Classification Search

CPC ..... C10G 45/22; C10G 65/06; C10G 65/04; C10G 65/02; C10G 65/00; C10G 67/06

See application file for complete search history.

(56) References Cited

U.S. PATENT DOCUMENTS

| | | | | |
|---|---|---|---|---|
| 4,036,745 | A * | 7/1977 | Broughton | C07C 7/13 208/310 Z |
| 4,130,476 | A | 12/1978 | Loboda | |
| 5,391,291 | A * | 2/1995 | Winquist | C10G 45/54 208/142 |
| 6,623,622 | B2 | 9/2003 | Gupta | |
| 6,623,628 | B1 | 9/2003 | Bronner et al. | |
| 6,797,154 | B2 | 9/2004 | Mukherjee et al. | |
| 6,835,301 | B1 | 12/2004 | Ellis et al. | |
| 7,384,540 | B2 | 6/2008 | Galeazzi | |
| 8,173,009 | B2 | 5/2012 | Kalnes | |
| 8,273,243 | B2 | 9/2012 | Nicolaos et al. | |
| 8,333,884 | B2 | 12/2012 | Hunter et al. | |
| 8,424,181 | B2 | 4/2013 | Lewis et al. | |
| 2006/0118466 | A1 | 6/2006 | Galeazzi et al. | |
| 2012/0103873 | A1 | 5/2012 | Sardar et al. | |
| 2012/0279900 | A1 | 11/2012 | Noureldin et al. | |
| 2013/0098802 | A1 | 4/2013 | Koseoglu et al. | |

OTHER PUBLICATIONS

Milosevic et al., "Improve energy efficiency for distillate hydrotreaters retrofit options . . . " Hydrocarbon Processing (2011), 90(6), 67-72.

Ahmad et al., "Integrated design of diesel hydrotreating processes," Chemical Engineering Research and Design (2011), 89(7), 1025-1036.

* cited by examiner

*Primary Examiner* — Renee Robinson
*Assistant Examiner* — Derek N Mueller

(57) ABSTRACT

A process for hydrotreating coker kerosene is described. Instead of a post treat reactor, a smaller trim reactor zone which operates at a lower pressure than the post treat reactor is used downstream of the product stripper. The trim reactor uses a noble metal catalyst to reduce the BI of the stripped product to less than about 150, and desirably in the range of about 50 to about 100.

19 Claims, 1 Drawing Sheet

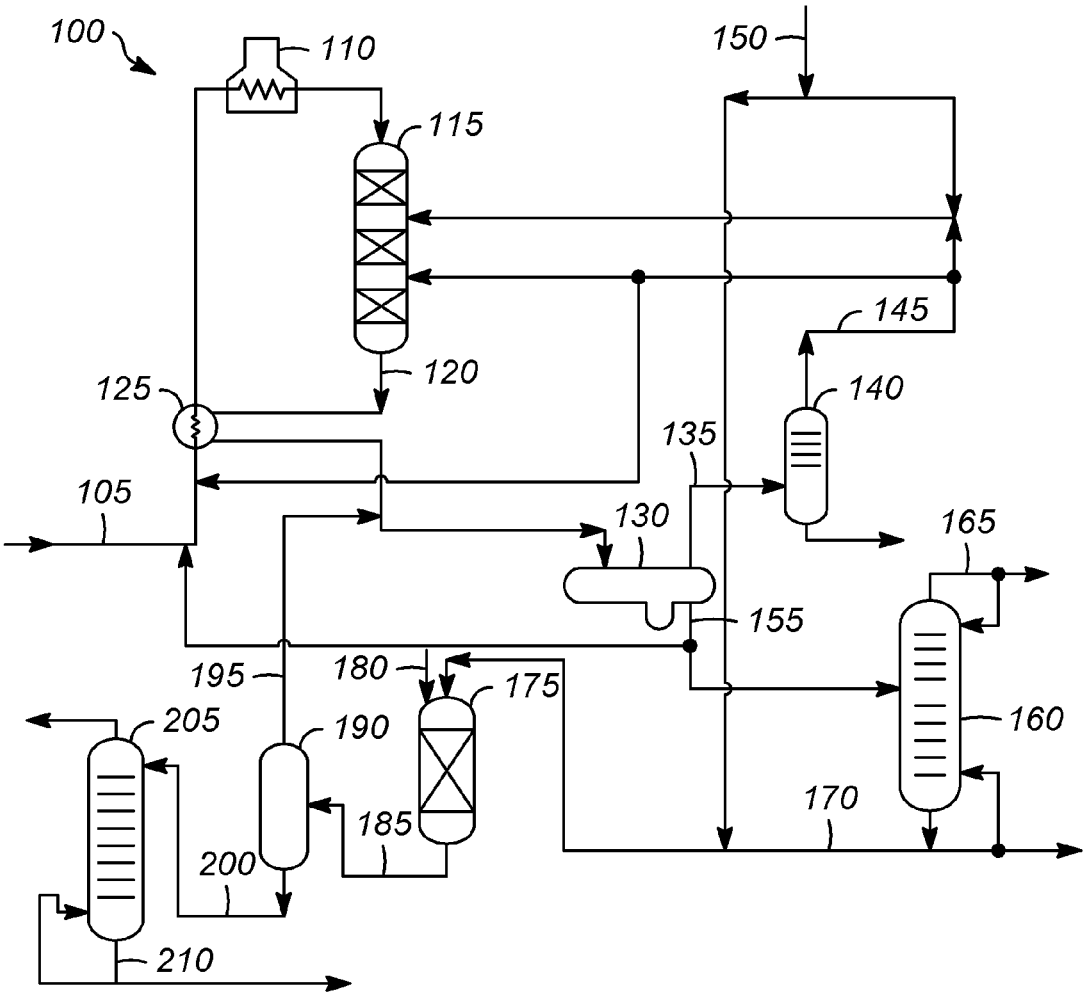
100
110
150
115
145
120
125
140
135
105
130
165
155
195
180
175
205
190
160
170
185
200
210

HYDROTREATING COKER KEROSENE WITH A SEPARATE TRIM REACTOR

BACKGROUND OF THE INVENTION

The delayed coker process converts the residue from heavy, high sulfur crudes into transportation fuels. The kerosene stream from the coker process is known as coker kerosene. It comprises hydrocarbons in the range of C9 to C20 and has a boiling point in the range of about 140° C. to about 320° C. It has a T5 point of 150° C. and a T95 point of 295° C. measured according to ASTM D86.

Coker kerosene contains high levels of sulfur (e.g., about 2 to about 5 wt %) and nitrogen (e.g., about 600-1000 wppm). Coker kerosene has to be hydrotreated to reduce the levels of sulfur and nitrogen before it can be treated in a separation unit, such as Molex™ to separate the n-paraffins from the non-normal hydrocarbons. The feed specifications for the Molex™ process include a sulfur level of less than 1 wppm, and a maximum nitrogen level of 0.5 wppm. Kerosene also contains olefins, and the olefins are saturated during the hydrotreating process. Another feed specification for the Molex™ process is a bromine index (BI) in the range of less than about 150.

In order to meet the sulfur, nitrogen, and BI specifications for a coker kerosene feed, severe hydrotreating at pressure in the range of about 7.6 MPa(g) (1100 psig) to about 8.3 MPa(g) (1200 psig) is required.

However, it is preferable to hydrotreat at the lowest possible pressure to reduce the capital cost of the unit. The sulfur and nitrogen specifications can be met at lower pressures, e.g., in the range of about 4.8 MPa(g) (700 psig) to about 6.2 MPa(g) (900 psig). However, the BI specification cannot be met by hydrotreating at that pressure.

Normally, a post treat reactor loaded with a hydrotreating catalyst is installed downstream of the main hydrotreating reactor to obtain the required BI. The post treat reactor has to operate at sufficiently high pressure and catalyst volume to meet the BI. Due to equilibrium limitations, the temperature of the post treat reactor needs to be in the range of about 250° C. and 350° C. to ensure that the required olefin saturation is obtained to meet BI requirement.

Even with the post treat reactor, it is not always possible to obtain BI values in the range of 50-100.

There is a need for lower cost processes to upgrade coker kerosene.

SUMMARY OF THE INVENTION

One aspect of the invention is a process for hydrotreating coker kerosene. In one embodiment, the process includes hydrotreating a coker kerosene feed stream in a hydrotreating zone in the presence of a hydrotreating catalyst to form a mixture of normal paraffins and non-normal hydrocarbons, the coker kerosene feed stream having a level of sulfur of at least about 1.0 wt %, and a level of nitrogen of at least about 500 wppm, a level of sulfur in the mixture being less than 1 wppm and a level of nitrogen in the mixture being 0.5 wppm or less. The mixture is separated in a gas-liquid separation zone into a vapor stream and a liquid stream, and the liquid stream is introduced into a stripper zone. The bottoms stream from the stripper zone is reacted in a trim reactor zone in the presence of a noble metal catalyst to reduce a bromine index of the bottoms stream, the trim reaction zone operating at a pressure of about 2.1 MPa(g) (300 psig) to about 6.2 MPa(g) (900 psig);. The effluent from the trim reactor zone has a level of sulfur of less than 1 wppm, a level of nitrogen of 0.5 wppm or less, and a bromine index of about 150 or less.

BRIEF DESCRIPTION OF THE DRAWING

The FIGURE is an illustration of one embodiment of a process for hydrotreating coker kerosene.

DETAILED DESCRIPTION OF THE INVENTION

In the present process, the post treat reactor is eliminated, and a smaller trim reactor is used downstream of the product stripper. The trim reactor uses a noble metal catalyst to reduce the BI of the stripped product to less than about 150, and desirably in the range of about 50 to about 100.

The main hydrotreating reactor effluent is cooled by heat exchange and routed to the separator. The separator liquid goes to the reboiled stripper. The stripper bottoms stream is pumped to the required pressure and undergoes heat exchange to obtain a temperature in the range of about 150° C. to about 200° C. It is then routed to the trim reactor.

The trim reactor operates at pressures of about 2.1 MPa(g) (300 psig) to about 6.2 MPa(g) (900 psig). A slip stream of hydrogen is added to the inlet of the trim reactor. The hydrogen amount is just enough to saturate the olefins present in the stripper bottoms. A noble metal catalyst is used in the trim reactor, and the trim reactor operates at near liquid phase. The gas to oil required is minimal, generally in the range of about 10 to about 20 SCFB.

The trim reactor effluent stream is routed to a flash drum where the excess hydrogen is separated from the liquid.

The liquid from the flash drum can be routed to a low pressure stripper. The hydrogen is completely removed from the liquid in the low pressure stripper. The low pressure stripper has a reboiler which uses hot oil as the heat source. The low pressure stripper is operated at very low pressure (e.g., about 45 kPa to about 75 kPa).

The flash drum vapor is routed under pressure control to the main hydrotreating reactor effluent air condenser.

The off-gas from the low pressure stripper can be routed to low pressure burners in the hot oil heater (or any heater in the complex), if desired. A condenser can be used on the vapor to condense any hydrocarbons that go with the overhead vapor.

The liquid from the flash drum can optionally be sent to a low pressure stripper.

The liquid can then be sent to a separation zone where the normal paraffins are separated from the non-normal hydrocarbons.

One embodiment of the process 100 is shown in the FIGURE. The coker kerosene feed stream 105 typically has a sulfur content of up to about 2.5 wt % and a nitrogen content of up to about 1000 wppm. The coker kerosene feed stream 105 typically contains at least about 90 wt % coker kerosene, or at least about 93 wt %, or at least about 95 wt %, or at least about 97 wt %, or at least about 98 wt %, or at least about 99 wt %.

The coker kerosene feed stream 105 is heated in charge heater 110 to a temperature of about 300° C. to about 400° C. before entering hydrotreating reaction zone 115. Hydrotreating is a process in which hydrogen gas is contacted with a hydrocarbon stream in the presence of suitable catalysts which are primarily active for the removal of heteroatoms, such as sulfur, nitrogen, oxygen, and metals from the hydrocarbon feedstock. In hydrotreating, hydrocarbons with double and triple bonds may be saturated.

Aromatics may also be saturated. Typical hydrotreating reaction conditions include a temperature of about 290° C. (550° F.) to about 455° C. (850° F.), or about 300° C. to about 400° C., a pressure of about 3.4 MPa(g) (500 psig) to about 27.6 MPa(g) (4000 psig), or about 4.8 MPa(g) (700 psig) to about 6.9 (1000 psig), a liquid hourly space velocity of about 0.5 $hr^{-1}$ to about 4 $hr^{-1}$, and a hydrogen rate of about 168 to about 1,011 $Nm^3/m^3$ oil (1,000-6,000 scf/bbl). Typical hydrotreating catalysts include at least one Group VIII B metal, preferably iron, cobalt and nickel, and at least one Group VI B metal, preferably molybdenum and tungsten, on a high surface area support material, preferably alumina and/or combination of alumina-silica. Other typical hydrotreating catalysts include zeolitic catalysts, as well as noble metal catalysts where the noble metal is selected from palladium and platinum.

The effluent 120 from the hydrotreating reaction zone 115 has a sulfur content of less than 1 wppm, and a nitrogen content of 0.5 wppm or less. However, the BI is typically above 150.

The effluent 120 from the hydrotreating reaction zone 115 can be heat exchanged with the coker kerosene feed stream 105 in heat exchanger 125 to reduce the temperature of the effluent 120. Alternatively (or additionally), the effluent 120 can be cooled using other known cooling methods.

The cooled effluent 120 is sent to a cold gas-liquid separation zone 130. The temperature of the cold gas-liquid separation zone 130 is generally close to ambient, e.g., about 20° C. to about 70° C. The pressure of the cold gas-liquid separation zone 130 is typically about 345 kPa(g) (50 psig) to about 689 kPa(g) (100 psig) less than the hydrotreating reaction zone, e.g., about 4.8 MPa(g) (700 psig) to about 6.9 MPa(g) (1000 psig).

The vapor stream 135 from the cold gas-liquid separation zone 130 is rich in hydrogen and contains other gases such as hydrogen sulfide, and nitrogen, and light hydrocarbons such as methane, ethane, propane, n-butane, and isobutane. The vapor stream 135 is treated in a gas scrubber 140. The clean vapor stream 145 can be recycled back to the hydrotreating reaction zone 115, if desired. Make-up hydrogen 150 can be added, if needed.

The liquid stream 155 from the cold gas-liquid separation zone 130 contains n-paraffins and non-normal hydrocarbons (e.g., isoparaffins and aromatics). The n-paraffins and non-normal hydrocarbons typically have carbon numbers in the range of 6 to 20. The liquid stream 155 can also include unconverted olefins from the hydrotreating reaction zone 115.

The liquid stream 155 is sent to stripper zone 160. The stripper zone 160 is operated at a pressure in the range of 1.0 MPa(g) to about 1.5 MPa(g). Any gases or light end hydrocarbons not removed in the cold gas-liquid separation zone 130 are stripped out in the stripper zone 160 in overhead stream 165.

Bottoms stream 170 containing n-paraffins, non-normal hydrocarbons, and unconverted olefins is sent to trim reactor zone 175. The trim reactor contains a noble metal catalyst. A hydrogen stream 180 is added to the trim reactor zone 175 which reacts with the olefins present in the bottoms stream 170. Trim reactor zone 175 is operated at a pressure in the range of about 2.1 MPa(g)(300 psig) to about 6.2 MPa(g) (900 psig). The pressure depends on the amount of olefins in the bottoms stream 170 and the specification for olefins in the desired product. The temperature is generally in the range of about 150° C. to about 200° C., with a liquid hourly space velocity in the range of about 10 $hr^{-1}$ to about 20 $hr^{-1}$. The saturation of the olefins in the trim reactor zone 175 reduces the BI to less than about 150, typically about 50 to about 150, or about 50 to about 100.

The effluent 185 from the trim reactor zone 175 is sent to the flash drum 190. The flash drum is typically at a temperature of about 20° C. to about 70° C. and a pressure of about 2.1 MPa(g)(300 psig) to about 6.2 MPa(g) (900 psig). The vapor 195 from the flash drum 190 can be sent to cold separator 130.

The liquid effluent 200 from the flash drum 190 can optionally be sent to low pressure stripper 205 to strip out hydrogen and to maintain the initial boiling point of the stripper bottom liquid. Low pressure stripper 205 operates at a pressure of about 45 to about 75 kPa. The liquid effluent 210 from the low pressure stripper 205 is sent to a liquid separation zone (not shown) where the normal paraffins are separated from the non-normal hydrocarbons in an adsorption zone, for example.

The process has several advantages over existing processes. First, the trim reactor can be operated at a much lower pressure (e.g., about 2.1 MPa(g) (300 psig) to about 6.2 MPa(g) (900 psig)) than the post treat reactor (e.g., 7.6 MPa(g) (1100 psig) to about to 8.3 MPa(g) (1200 psig)) which is located in the high pressure recycle gas loop. In addition, the trim reactor is smaller than the post treat reactor because there is no recycle gas passing through it and because it uses a noble metal catalyst rather than the base metal catalyst used in the post treat reactor. The trim reactor is not directly dependent on the operation of the hydrotreating reactor and can provide much better control on the BI. The fresh feed in the main hydrotreating reactor can be split to the two top beds to have better control of the temperature rise due to the olefin saturation, if desired.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

What is claimed is:

1. A process for hydrotreating coker kerosene comprising:

hydrotreating a coker kerosene feed stream in a hydrotreating zone in the presence of a hydrotreating catalyst to form a mixture of normal paraffins and non-normal hydrocarbons, the coker kerosene feed stream having a level of sulfur of at least about 1.0 wt %, and a level of nitrogen of at least about 500 wppm, a level of sulfur in the mixture being less than 1 wppm and a level of nitrogen in the mixture being 0.5 wppm or less;

separating the mixture in a gas-liquid separation zone into a vapor stream and a liquid stream;

introducing the liquid stream into a stripper zone;

reacting a bottoms stream from the stripper zone in a trim reactor zone in the presence of a noble metal catalyst to reduce a bromine index of the bottoms stream, the trim reaction zone operating at a pressure of about 2.1 MPa (g) (300 psig) to about 6.2 MPa (g) (900 psig), a gas to oil ratio of less than about 20 SCFB and a temperature of about 150° C. to about 200° C.;

wherein an effluent from the trim reactor zone has a level of sulfur of less than 1 wppm, a level of nitrogen of 0.5 wppm or less, and a bromine index of about 150 or less.

2. The process of claim 1 further comprising introducing the effluent from the trim reactor zone into a liquid separation zone to separate the normal paraffins from the non-normal hydrocarbons.

3. The process of claim 2 wherein the liquid separation zone is an adsorption zone.

4. The process of claim 2 further comprising separating hydrogen from the effluent from the trim reactor zone in a low pressure flash drum zone before introducingthe effluent from the trim reactor zone into the liquid separation zone.

5. The process of claim 4 further comprising introducing effluent from the low pressure flash drum zone into a low pressure stripper zone to remove hydrogen before introducing the effluent from the trim reactor zone into the liquid separation zone.

6. The process of claim 5 wherein the low pressure stripper zone operates at a pressure in a range of about 45 kPa to about 75 kPa.

7. The process of claim 1 further comprising introducing hydrogen to the trim reactor zone to saturate olefins.

8. The process of claim 1 further comprising reducing a temperature of the mixture before separating the mixture in the gas-liquid separation zone.

9. The process of claim 8 wherein the temperature of the mixture is reduced by heat exchange with the coker kerosene feed stream.

10. The process of claim 1 wherein the coker kerosene feed stream contains at least about 90 wt % coker kerosene.

11. The process of claim 1 wherein the effluent from the trim reactor zone has a bromine index of about 100 or less.

12. A process for hydrotreating coker kerosene comprising:

hydrotreating a coker kerosene feed stream in a hydrotreating zone in the presence of a hydrotreating catalyst to form a mixture of normal paraffins and non-normal hydrocarbons, wherein the coker kerosene feed stream contains at least about 90 wt % coker kerosene, wherein the coker kerosene feed stream has a level of sulfur of at least about 1.0 wt %, and a level of nitrogen of at least about 500 wppm, a level of sulfur in the mixture being less than 1 wppm and a level of nitrogen in the mixture being 0.5 wppm or less;

separating the mixture in a gas-liquid separation zone into a vapor stream and a liquid stream;

introducing the liquid stream into a stripper zone;

reducing a bromine index of a bottoms stream from the stripper zone below 100 by reacting the bottoms stream in a trim reactor zone in the presence of a noble metal catalyst and hydrogen, the trim reaction zone operating at a pressure of about 2.1 MPa(g) (300 psig) to about 6.2 MPa(g) (900 psig) and having a gas to oil ratio of about 10 to about 20 SCFB, wherein an effluent from the trim reactor zone has a level of sulfur of less than 1 wppm, and a level of nitrogen of 0.5 wppm or less;

separating hydrogen from the effluent from the trim reactor zone in a low pressure flash drum zone; and introducing the effluent from the flash drum zone into a liquid separation zone to separate the normal paraffins from the non-normal hydrocarbons.

13. The process of claim 12 wherein the liquid separation zone is an adsorption zone.

14. The process of claim 12 further comprising introducing effluent from the low pressure flash drum zone into a low pressure stripper zone to remove hydrogen before introducing the effluent from the trim reactor zone into the liquid separation zone.

15. The process of claim 14 wherein the low pressure stripper zone operates at a pressure in a range of about 45 kPa to about 75 kPa.

16. The process of claim 12 further comprising introducing hydrogen to the trim reactor zone to saturate olefins.

17. The process of claim 12 further comprising reducing a temperature of the mixture before separating the mixture in the gas-liquid separation zone.

18. The process of claim 17 wherein the temperature of the mixture is reduced by heat exchange with the coker kerosene feed stream.

19. The process of claim 12 wherein the trim reactor zone operates at a temperature in a range of about 150° C. to about 200° C.

* * * * *